US011609527B2

(12) United States Patent
Oshiro

(10) Patent No.: US 11,609,527 B2
(45) Date of Patent: Mar. 21, 2023

(54) IMAGE FORMING APPARATUS WITH RESTRICTED ROTATABLE FEED TRAY

(71) Applicant: TOSHIBA TEC KABUSHIKI KAISHA, Tokyo (JP)

(72) Inventor: Toshiaki Oshiro, Izu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 194 days.

(21) Appl. No.: 17/110,551

(22) Filed: Dec. 3, 2020

(65) Prior Publication Data

US 2021/0356896 A1 Nov. 18, 2021

(30) Foreign Application Priority Data

May 13, 2020 (JP) ..... JP2020-084330

(51) Int. Cl.
*G03G 21/16* (2006.01)
*G03G 15/00* (2006.01)
*B65H 3/06* (2006.01)

(52) U.S. Cl.
CPC ..... *G03G 21/1633* (2013.01); *G03G 15/6514* (2013.01); *G03G 21/16* (2013.01);
(Continued)

(58) Field of Classification Search
CPC ..... G03G 15/0142; G03G 15/234; G03G 15/605; G03G 15/6514; G03G 15/70; G03G 21/16; G03G 21/1604; G03G 21/1633; G03G 21/1638; G03G 21/1642; G03G 21/1647; G03G 2215/00004; G03G 2215/00016; G03G 2215/00392; G03G 2215/00438; G03G 2215/00544;
(Continued)

(56) References Cited

U.S. PATENT DOCUMENTS 4,545,668 A 10/1985 Zaitsu
2008/0003045 A1 1/2008 Hattori et al.
(Continued)

FOREIGN PATENT DOCUMENTS

JP 2008-308329 12/2008
JP 2010-097161 4/2010
(Continued)

OTHER PUBLICATIONS

Extended European Search Report for European Patent Application No. 21157602.0 dated Jun. 25, 2021.

*Primary Examiner* — Joseph S Wong
(74) *Attorney, Agent, or Firm* — Amin, Turocy & Watson, LLP

(57) ABSTRACT

According to one embodiment, an image processing apparatus includes an apparatus main body, a first rotating body, a second rotating body, and a connection member. The first rotating body is configured to be openable and closeable and provided in the apparatus main body. The second rotating body is provided in the first rotating body. The second rotating body is configured to be openable and closable from the first rotating body in the same direction as that of the first rotating body. The connection member is linear. The connection member is configured to connect the apparatus main body and the second rotating body to each other and to restrict a rotation angle of the second rotating body.

16 Claims, 11 Drawing Sheets

(52) U.S. Cl.
CPC ..... *G03G 21/1638* (2013.01); *B65H 3/0607* (2013.01); *B65H 2407/21* (2013.01); *G03G 15/605* (2013.01); *G03G 2215/00392* (2013.01); *G03G 2215/00544* (2013.01); *G03G 2221/1675* (2013.01)

(58) Field of Classification Search
CPC ..... G03G 2215/019; G03G 2221/1675; G03G 2221/1678; G03G 2221/1687; G03G 2221/169; B65H 3/0607; B65H 2407/21
See application file for complete search history.

(56) References Cited

U.S. PATENT DOCUMENTS

| | | | | |
|---|---|---|---|---|
| 2008/0025749 | A1* | 1/2008 | Igarashi | G03G 21/1647 399/92 |
| 2011/0266743 | A1 | 11/2011 | Yamamoto | |
| 2014/0186083 | A1 | 7/2014 | Lee et al. | |
| 2014/0212195 | A1 | 7/2014 | Aoyama | |
| 2015/0001794 | A1* | 1/2015 | Doi | B65H 1/04 271/145 |
| 2018/0004151 | A1* | 1/2018 | Tsuda | G03G 21/1633 |

FOREIGN PATENT DOCUMENTS

| | | |
|---|---|---|
| JP | 2012-013828 | 1/2012 |
| JP | 2019-043711 | 3/2019 |

* cited by examiner

IMAGE FORMING APPARATUS WITH RESTRICTED ROTATABLE FEED TRAY

CROSS-REFERENCE TO RELATED APPLICATION

This application is based upon and claims the benefit of priority from Japanese Patent Application No. 2020-084330, filed on May 13, 2020, the entire contents of which are incorporated herein by reference.

FIELD

Embodiments described herein relate generally to an image processing apparatus.

BACKGROUND

The image processing apparatus includes a manual feed tray. The manual feed tray is attached to a conveyance unit that forms a conveyance path in the image processing apparatus. The conveyance unit is openable and closable and fixed to an apparatus main body of the image processing apparatus such that jammed paper of the conveyance path can be removed.

In the conveyance unit, the manual feed tray is openable and closable in the same direction as that of the conveyance unit.

If jammed paper of the conveyance path is removed, it is recommended to open the conveyance unit after closing the manual feed tray. However, some users may open the conveyance unit in a state where the manual feed tray is opened. In this case, since the tilt of the manual feed tray is excessively large, paper on the manual feed tray falls.

It is also considered to provide a stopper that prevents paper from falling in the manual feed tray. However, in consideration of easiness of removal of jammed paper and easiness of placement of paper on the manual feed tray, an opening angle of each of the conveyance unit and the manual feed tray is desirably close to 90 degrees. In this case, if the conveyance unit is opened in a state where the manual feed tray is opened, the manual feed tray is tilted to be substantially vertical. Therefore, there may be a case where the stopper cannot stop paper from falling.

DETAILED DESCRIPTION

Embodiments provide an image processing apparatus in which tilt of a second rotating body can be restricted even when a first rotating body is opened in a state where the second rotating body is opened.

An image processing apparatus according to one embodiment includes an apparatus main body, a first rotating body, a second rotating body, and a connection member. The first rotating body is configured to be openable and closeable and provided in the apparatus main body. The second rotating body is provided in the first rotating body. The second rotating body is configured to be openable and closable from the first rotating body in the same direction as that of the first rotating body. The connection member is linear. The connection member is configured to connect the apparatus main body and the second rotating body to each other and to restrict a rotation angle of the second rotating body.

Hereinafter, an image processing apparatus according to an embodiment will be described.

Figure 1:
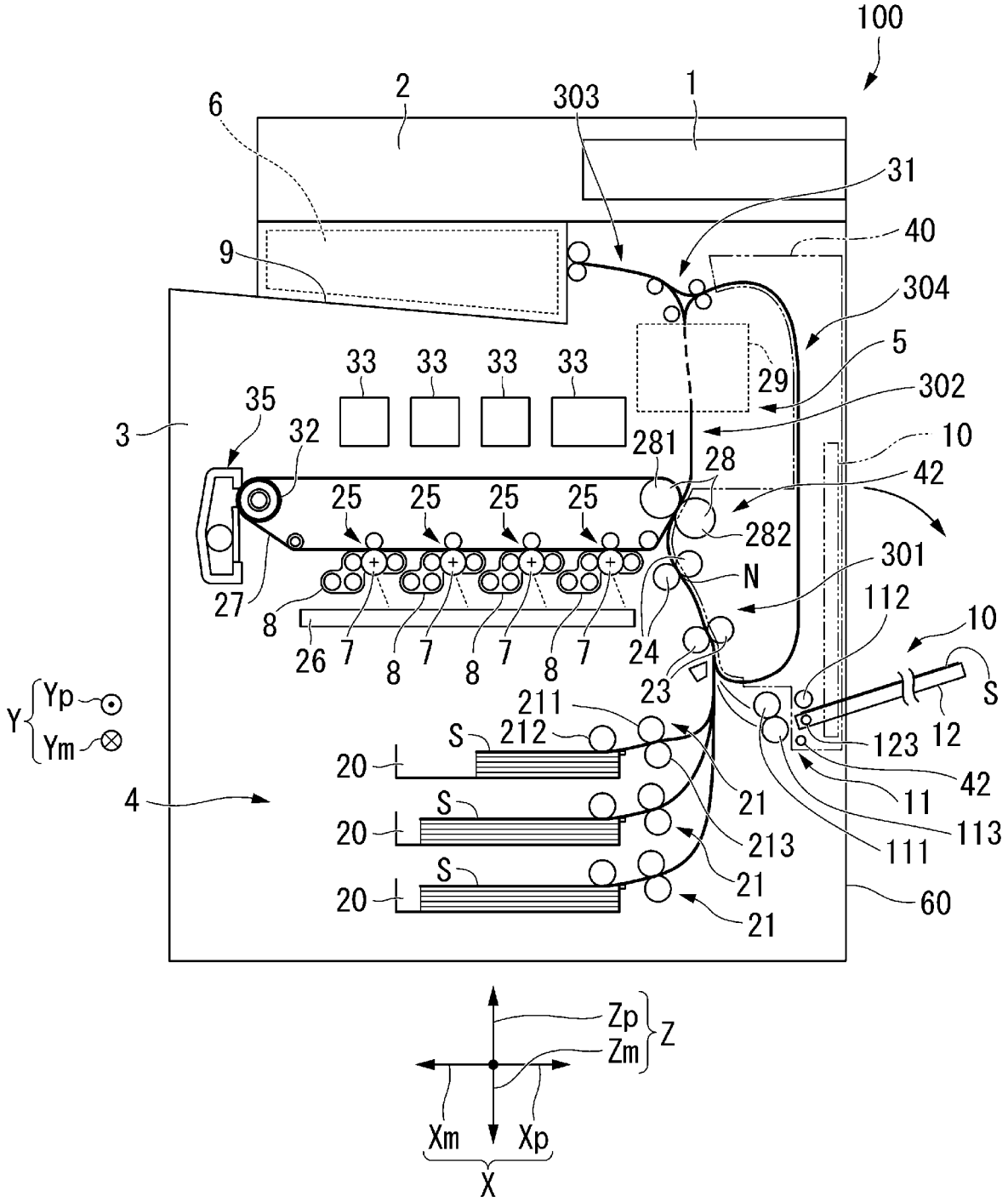
FIG. 1 is a schematic cross-sectional view illustrating a configuration example of an image processing apparatus according to an embodiment.

FIG. 1 is a schematic diagram illustrating a configuration example of the image processing apparatus according to the embodiment.

As illustrated in FIG. 1, an image processing apparatus 100 according to the embodiment includes a control panel 1, a scanner unit 2, a printer unit 3, a sheet supply unit 4, a conveying unit 5, a manual feed unit 10 (sheet conveying device), and a control circuit 6.

Hereinafter, an Xp direction, an Xm direction, a Yp direction, a Ym direction, a Zp direction, and a Zm direction in the drawings may be used with respect to a relative position of the image processing apparatus 100. The Xp direction is a direction from the left to the right when seen from the front side (the front side of a plane in FIG. 1) of the image processing apparatus 100. The Xm direction is a direction opposite to the Xp direction. The Yp direction is a direction from a rear surface to a front surface of the image processing apparatus 100. The Ym direction is a direction opposite to the Yp direction. The Zp direction is a vertically upward direction. The Zm direction is a vertically downward direction. When orientations of the Xp (Yp, Zp) direction and the Xm (Ym, Zm) direction do not matter or when a direction includes both the Xp (Yp, Zp) direction and the Xm (Ym, Zm) direction, this direction will be simply referred to "X (Y, Z) direction".

Hereinafter, a plane having a normal line in the X direction will be referred to as "YZ plane", a plane having a normal line in the Y direction will be referred to as "ZX plane", and a plane having a normal line in the Z direction will be referred to as "XY plane". The ZX plane is parallel to a conveying direction of a sheet S described below in the image processing apparatus 100. The XY plane is a horizontal plane.

The control panel 1 is operated by a user to operate the image processing apparatus 100.

The scanner unit 2 reads image information of a copying object based on brightness and darkness of light. The scanner unit 2 outputs the read image information to the printer unit 3.

The printer unit 3 forms an image on the sheet S based on image information from the scanner unit 2 or an external apparatus.

The printer unit 3 forms an output image (toner image) with a developer including toner. The printer unit 3 transfers the toner image to a surface of the sheet S. The printer unit 3 applies heat and pressure to the toner image on the surface of the sheet S to fix the toner image to the sheet S.

The sheet supply unit 4 supplies the sheet S to the printer unit 3 one by one at a timing at which the printer unit 3 forms the toner image.

The sheet supply unit 4 includes a plurality of paper feed cassettes 20 and a plurality of cassette paper feed units 21.

The paper feed cassettes 20 accommodate sheets S having various sizes. In the example illustrated in FIG. 1, the paper feed cassettes 20 are provided on three stages.

The cassette paper feed units 21 are disposed above end portions of the respective paper feed cassettes 20 in the Xp direction. Each of the cassette paper feed units 21 includes a pickup roller 212, a paper feed roller 211, and a separation roller 213.

The pickup roller 212 conveys the sheet S required for forming an image from the paper feed cassette 20 to a nip portion between the paper feed roller 211 and the separation roller 213.

The paper feed roller 211 conveys the sheet S conveyed to the nip portion to the conveying unit 5.

If a plurality of sheets S are conveyed, the separation roller 213 separates one sheet S from the sheets S.

The conveying unit 5 includes a conveying roller 23 and a registration roller 24. The conveying unit 5 conveys the sheet S supplied from the sheet supply unit 4 to the registration roller 24.

The registration roller 24 conveys the sheet S at a timing at which the printer unit 3 transfers the toner image to the sheet S.

The conveying roller 23 allows a tip of the sheet S in a conveying direction to abut against a nip N of the registration roller 24. The conveying roller 23 aligns a position of the tip of the sheet S in the conveying direction by bending the sheet S.

The registration roller 24 aligns the tip of the sheet S conveyed from the conveying roller 23 in the nip N. Further, the registration roller 24 conveys the sheet S to a transfer unit 28 side described below.

The conveying unit 5 includes conveyance paths 301, 302, 303, and 304. The conveyance paths 301, 302, 303, and 304 will be described after describing other configurations of the printer unit 3.

The printer unit 3 includes a plurality of image forming units 25, a plurality of exposure units 26, an intermediate transfer belt 27, the transfer unit 28, a fixing unit 29, and a transfer belt cleaning unit 35.

Four image forming units 25 are disposed in the Xp direction.

Each of the image forming units 25 forms a toner image on the intermediate transfer belt 27, the toner image being transferred to the sheet S.

Each of the image forming units 25 includes a photoconductive drum 7. The image forming units 25 form toner images of yellow, magenta, cyan, and black on the photoconductive drums 7, respectively.

In the vicinity of each of the photoconductive drums 7, a charging unit, a developing unit 8, a primary transfer roller, a cleaning unit, and a charge eraser are disposed. The primary transfer roller faces the photoconductive drum 7. The intermediate transfer belt 27 is interposed between the primary transfer roller and the photoconductive drum 7. The exposure unit 26 is disposed below the charging unit and the developing unit 8.

A toner cartridge 33 is disposed above each of the image forming units 25. Colors of toners accommodated in the respective toner cartridges 33 are different from each other. Four toner cartridges 33 accommodate toners of yellow, magenta, cyan, and black, respectively.

The toners of the toner cartridges 33 are supplied to the image forming units 25 positioned below the toner cartridges 33, respectively, through toner replenishment tubes (not illustrated).

The exposure unit 26 irradiates the charged surface of each of the photoconductive drums 7 with laser light. The emission of the laser light is controlled based on the image information. The exposure unit 26 can adopt a configuration of irradiating the surface of the photoconductive drums 7 with LED light instead of laser light. In the example illustrated in FIG. 1, the exposure unit 26 is disposed below the image forming units 25.

Image information corresponding to yellow, magenta, cyan, and black are supplied to the exposure unit 26.

The exposure unit 26 forms an electrostatic latent image on the surface of each of the photoconductive drums 7 based on the image information.

The intermediate transfer belt 27 is formed of an endless belt. A plurality of rollers abutting against an inner circumferential surface of the intermediate transfer belt 27 applies a tensile force to the intermediate transfer belt 27. The intermediate transfer belt 27 is stretched flat. An inner circumferential surface of the intermediate transfer belt 27 abuts against a support roller 281 at a position in the Xp direction that is most distant in a stretching direction. The inner circumferential surface of the intermediate transfer belt 27 abuts against a transfer belt roller 32 at a position in the Xm direction that is most distant in the stretching direction.

The support roller 281 forms a part of the transfer unit described below. The support roller 281 guides the intermediate transfer belt 27 to a secondary transfer position.

The transfer belt roller 32 guides the intermediate transfer belt 27 to a cleaning position.

On a lower surface side of the intermediate transfer belt 27 in the drawing, each of the image forming units 25 excluding the primary transfer roller is disposed in the Xp direction. The respective image forming units 25 are disposed at intervals in a region between the transfer belt roller 32 and the support roller 281.

If the toner image reaches a primary transfer position, a transfer bias is applied to the primary transfer roller of each of the image forming units 25. The primary transfer rollers transfer (primarily transfer) the toner images on the surfaces of each of the photoconductive drums 7 to the intermediate transfer belt 27.

In the intermediate transfer belt 27, the transfer unit 28 is disposed at a position that is closest to the image forming unit 25 in the Xp direction.

The transfer unit 28 includes the support roller 281 and a secondary transfer roller 282. The intermediate transfer belt 27 is interposed between the secondary transfer roller 282 and the support roller 281. A position where the secondary transfer roller 282 and the intermediate transfer belt 27 abut against each other is a secondary transfer position.

The transfer unit 28 transfers the charged toner image on the intermediate transfer belt 27 to a surface of the sheet S at a secondary transfer position. The transfer unit 28 applies a transfer bias to the secondary transfer position. The transfer unit 28 transfers the toner image on the intermediate transfer belt 27 to the sheet S using the transfer bias.

The fixing unit 29 applies heat and pressure to the sheet S. The fixing unit 29 fixes the transferred toner image to the sheet S using the heat and pressure. The fixing unit 29 is disposed above the transfer unit 28.

The transfer belt cleaning unit 35 faces the transfer belt roller 32. The intermediate transfer belt 27 is interposed in the transfer belt cleaning unit 35. The transfer belt cleaning unit 35 scrapes the toner on the surface of the intermediate transfer belt 27.

In a region between from the registration roller 24 to the transfer unit 28 and a region from the transfer unit 28 to the fixing unit 29, the conveyance paths 301 and 302 that convey the sheet S from below to above are formed in this order. In a region between the fixing unit 29 to a paper discharge port, the conveyance path 303 that discharges the sheet S in the horizontal direction is formed.

Above the fixing unit 29, a conveying direction switching unit 31 that switches a conveying direction of the sheet S is provided.

In a region inside the printer unit 3 on the side in the Xp direction further than the conveyance paths 301 and 302, the conveyance path 304 that conveys the sheet S from the conveying direction switching unit 31 on the fixing unit 29 to the registration roller 24 is formed. For example, if duplex printing is executed, the conveyance path 304 is used to invert the sheet S having a surface on which an image is formed and to convey the inverted sheet S to the registration roller 24.

Each of the conveyance paths 301, 302, 303, and 304 includes conveyance guide portions that face each other with respect to the sheet S and a conveying roller that is optionally provided.

In the conveyance paths 301 and 302 and a part of the conveyance path 304, the conveyance guide portion and the conveying roller in the Xp direction are supported by the conveyance unit 40 (first rotating body). Likewise, the registration roller 24 and the secondary transfer roller 282 on the side in the Xp direction are also supported by the conveyance unit 40.

In a rotating support unit 42 that is provided in an apparatus main body 60, the conveyance unit 40 is supported to be rotatable around an axis extending in the Y direction. The apparatus main body 60 supports the respective device portions in the printer unit 3. The apparatus main body 60 is a complex body of structural members, for example, a bottom plate, a side plate, and a stay.

The conveyance unit 40 can move between a closed state where the conveyance unit 40 is rotated counterclockwise when seen from the Ym direction and an opened state where the conveyance unit 40 is rotated clockwise when seen from the Ym direction.

In the closed state of the conveyance unit 40, the sheet S can be conveyed in the conveyance paths 301, 302, and 304. In the opened state of the conveyance unit 40, the conveyance paths 301, 302, and 304 are opened. Therefore, jammed paper is easily removed.

The manual feed unit 10 supplies the sheet S on which an image is formed to the printer unit 3.

The manual feed unit 10 includes a manual paper feed portion 11 and a manual feed tray 12 (second rotating body).

The manual feed tray 12 is flat as a whole. In a rotating support unit 123 that is provided in the conveyance unit 40, the manual feed tray 12 is supported to be rotatable around an axis extending in the Y direction. During the use of the manual feed tray 12, as indicated by a solid line, the manual feed tray 12 is rotated and opened clockwise when seen from the Ym direction. Sheets Shaving various sizes can be placed on the opened manual feed tray 12.

During non-use of the manual feed tray 12, as indicated by a two-dot chain line, the manual feed tray 12 is rotated counterclockwise in the drawing and accommodated in the conveyance unit 40.

If the manual feed tray 12 is accommodated in the conveyance unit 40, a relative position to the conveyance unit 40 is locked by an engagement member (not illustrated). In a state where the manual feed tray 12 is accommodated, even when the conveyance unit 40 is in the opened state, the manual feed tray 12 may be opened due to its own weight.

The manual paper feed portion 11 separates and feeds the sheet S placed on the manual feed tray 12 and conveys the sheet S to the registration roller 24.

The manual paper feed portion 11 includes a pickup roller 112, a paper feed roller 111, and a separation roller 113.

The pickup roller 112, the paper feed roller 111, and the separation roller 113 have the same configurations as those of the pickup roller 212, the paper feed roller 211, and the separation roller 213 in the cassette paper feed unit 21.

Figure 2:
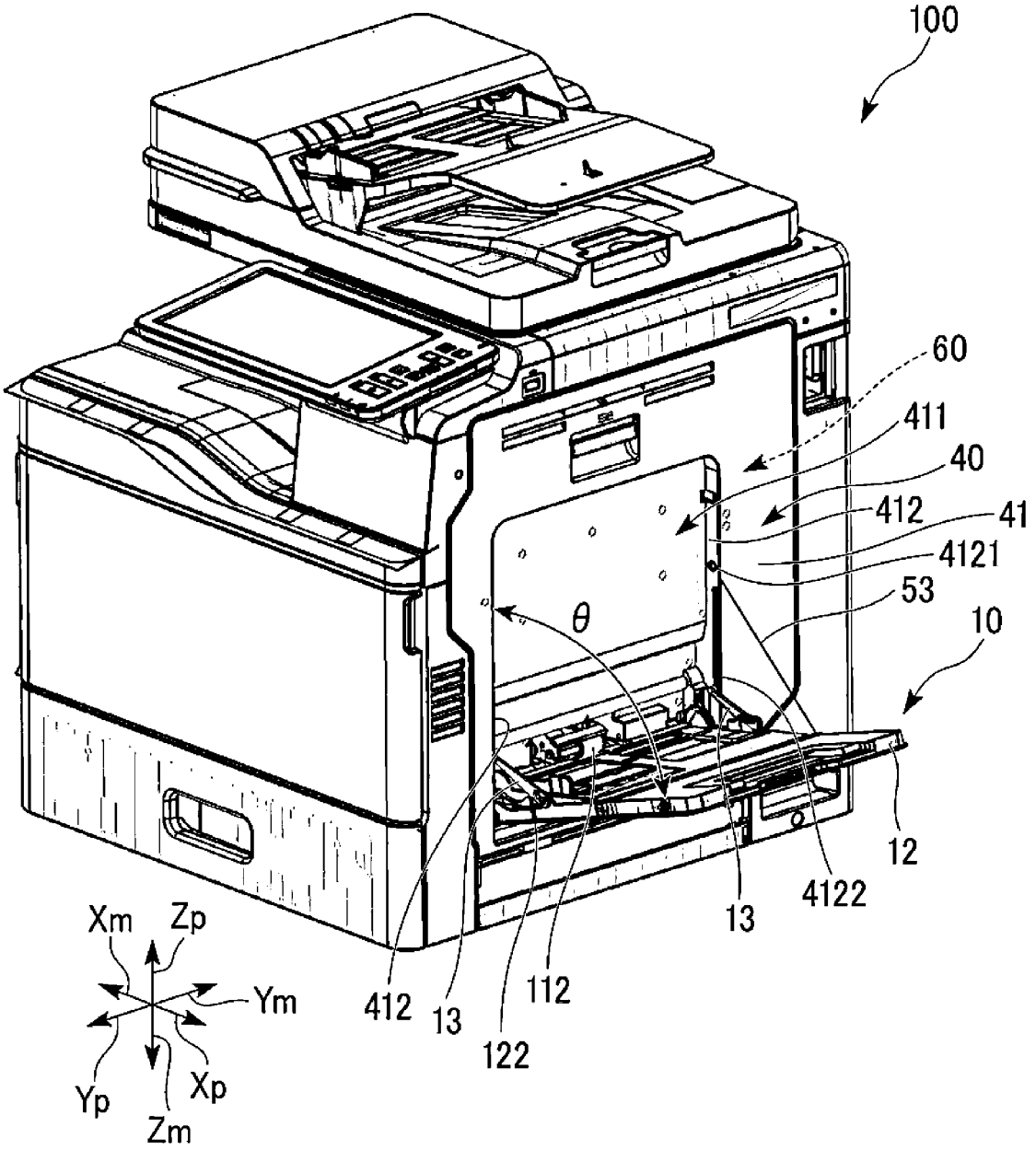
FIG. 2 is a schematic perspective view illustrating a state where a manual feed tray in the image processing apparatus is opened.
Figure 3:
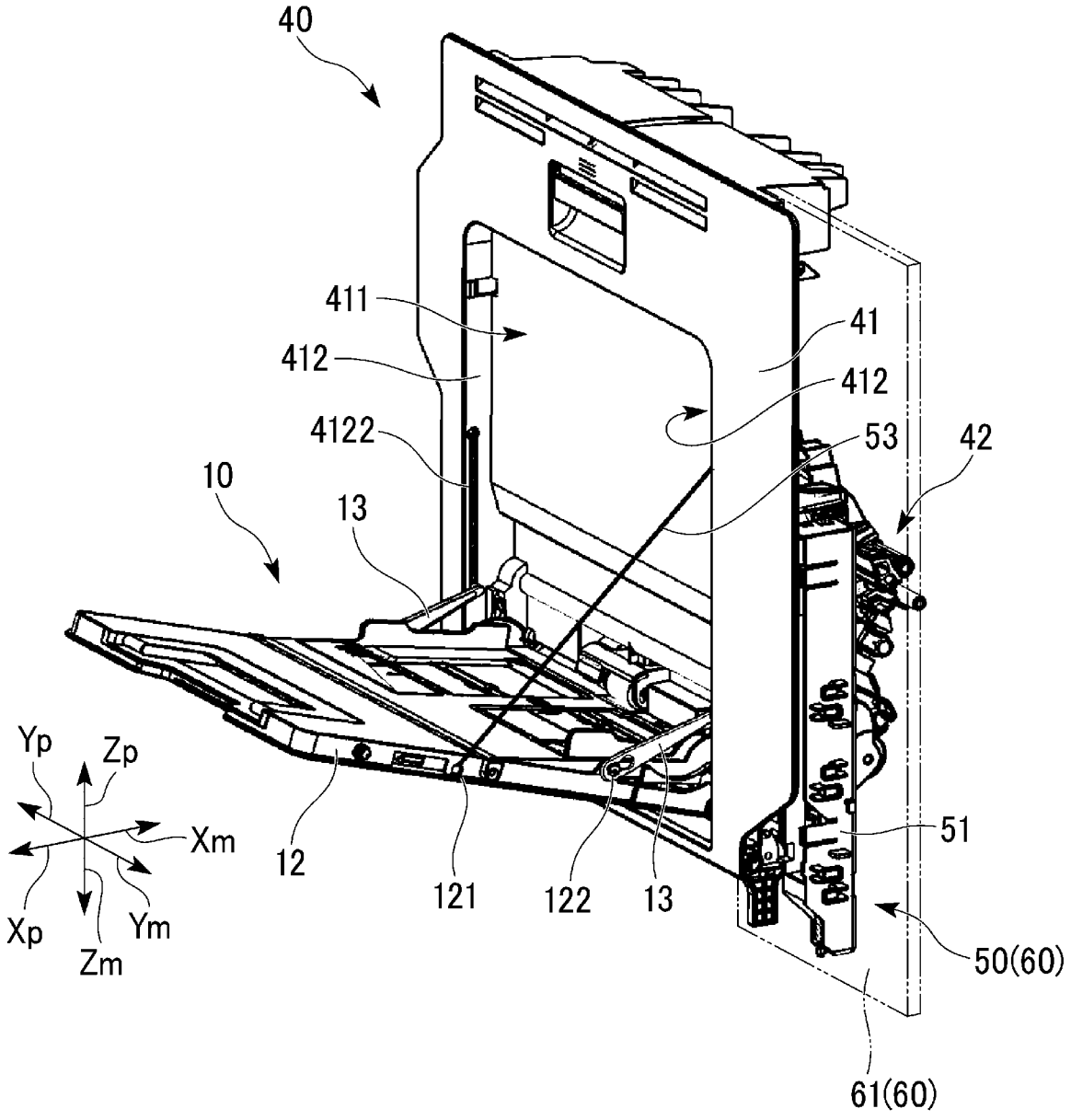
FIG. 3 is a schematic perspective view illustrating major parts of the manual feed tray and an apparatus main body in the image processing apparatus.

FIG. 2 is a schematic perspective view illustrating a state where the manual feed tray in the image processing apparatus according to the embodiment is opened. FIG. 3 is a schematic perspective view illustrating major parts of the manual feed tray and the apparatus main body in the image processing apparatus according to the embodiment.

As illustrated in FIG. 2, the conveyance unit 40 includes an exterior cover 41 that covers the Xp direction. The exterior cover 41 includes a manual feed tray accommodation portion 411 as a recess portion that accommodates the manual feed tray 12 in a state where the manual feed tray 12 is closed.

As illustrated in FIGS. 2 and 3, the manual feed tray 12 is connected to the conveyance unit 40 through a link 13 that is rotatable and connected to a rotating support point 122 provided at each of opposite end portions in the Y direction.

An end portion of each of the links 13 opposite to the rotating support point 122 engages with a guide groove 4122 that is provided at a side plate portion 412 of the manual feed tray accommodation portion 411 in the Y direction. Each of the guide grooves 4122 extends in a longitudinal direction of the side plate portion 412 (the Z direction in the closed state of the conveyance unit 40).

With this configuration, the manual feed tray 12 is openable and closable and supported by the conveyance unit 40.

The manual feed tray 12 is accommodated in the manual feed tray accommodation portion 411 in the closed state.

Further, the manual feed tray 12 is connected to the apparatus main body 60 of the printer unit 3 through a connection member 53.

The connection member 53 is a linear body having flexibility. For example, as the connection member 53, a wire, a rope, or the like formed of a metal or a resin may be used. Hereinafter, an example in which a cross-sectional shape of the connection member 53 perpendicular to the longitudinal direction is substantially circular will be described. If the cross-sectional shape of the connection member 53 is substantially circular, even in a case where the connection member 53 is twisted, there is a small change in the sliding resistance of a counterpart member with which the connection member 53 comes into contact.

The connection member 53 may be connected to each of opposite side portions of the manual feed tray 12 in the Y direction. Hereinafter, as illustrated in FIG. 2, an example in which the connection member 53 is connected to only one side portion in the Ym direction will be described.

The connection member 53 extends to the outside from a hole 4121 (insertion hole) that penetrates the side plate portion 412 of the manual feed tray accommodation portion 411 in the Ym direction. The hole 4121 is an example of the insertion hole formed in the conveyance unit 40.

As illustrated in FIG. 3, a first end portion 531 of the connection member 53 is fixed to a fixing portion 121 that is provided in the side portion of the manual feed tray 12 in the Ym direction.

An end portion of the connection member 53 opposite to the first end portion 531 is fixed to a sagging prevention mechanism 50 (refer to FIG. 3) described below.

The connection member 53 is drawn into the sagging prevention mechanism 50 in the apparatus main body 60. If the manual feed tray 12 is opened in the closed state of the conveyance unit 40, the connection member 53 has a length at which the connection member 53 can be drawn out from the sagging prevention mechanism 50. In this state, an opening angle of the manual feed tray 12 is restricted by each of the links 13.

Figure 4:
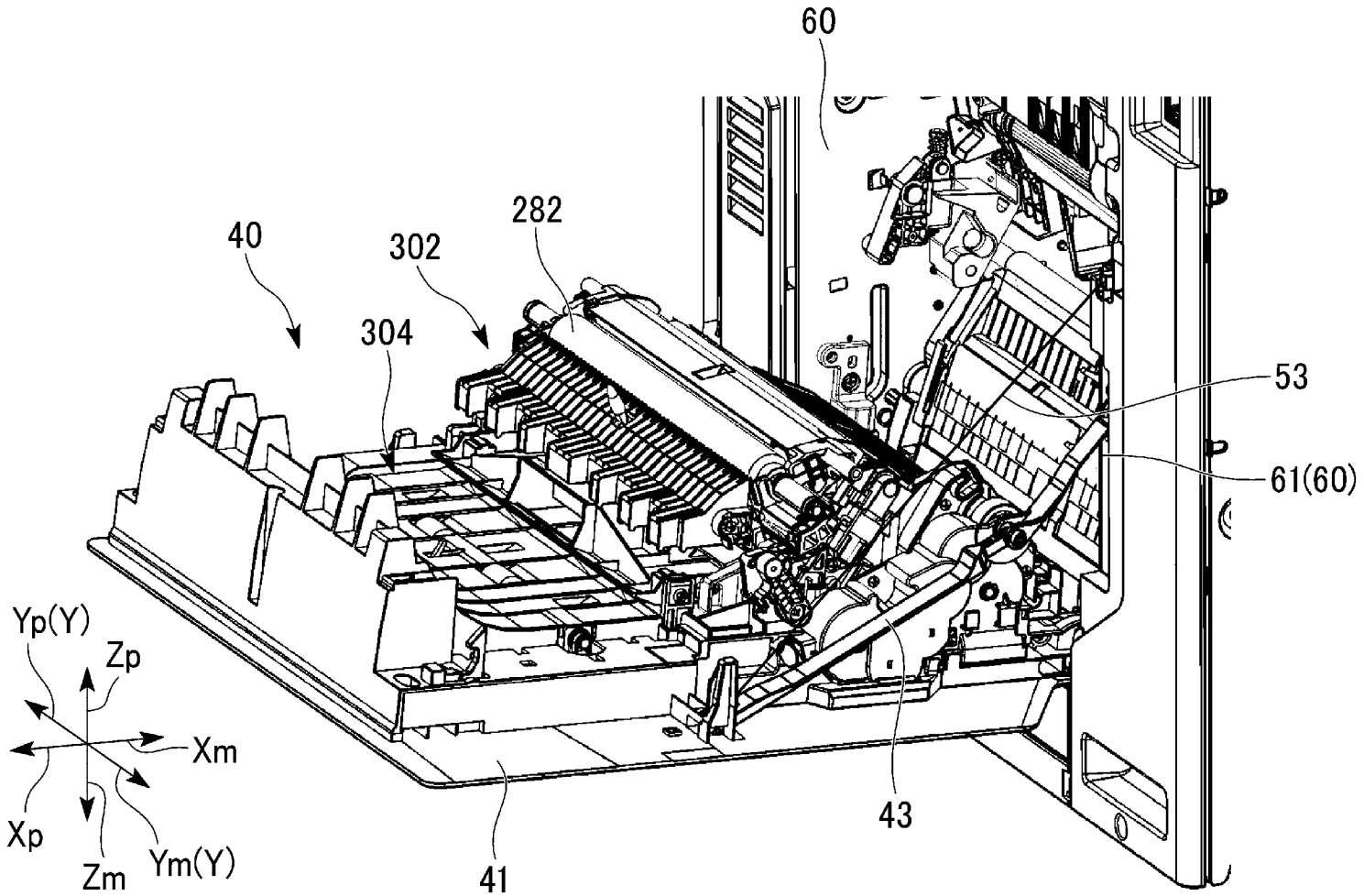
FIG. 4 is a schematic perspective view illustrating a state where a conveyance unit in the image processing apparatus is opened.

FIG. 4 is a schematic perspective view illustrating a state where the conveyance unit in the image processing apparatus according to the embodiment is opened.

FIG. 4 shows a state when the conveyance unit 40 is opened in the closed state of the manual feed tray 12.

The conveyance unit 40 is connected to an end portion of a rear plate 61 of the apparatus main body 60 in the Xm direction through a connection band 43. The connection band 43 may be connected to each of opposite side portions of the conveyance unit 40 in the Y direction. Hereinafter, as illustrated in FIG. 4, an example in which the connection member 53 is connected to only one side portion in the Ym direction will be described.

The connection band 43 is a band-shaped body having a strength with which the weight of the conveyance unit 40 can be supported. For example, the connection band 43 is formed of a synthetic resin.

An end portion of the connection band 43 opposite to the rear plate 61 is fixed to the exterior cover 41.

If the conveyance unit 40 is opened in the closed state of the manual feed tray 12, the connection member 53 has a length at which the connection member 53 can be drawn out from the sagging prevention mechanism 50. In this state, an opening angle of the conveyance unit 40 is restricted by the connection band 43.

Next, the sagging prevention mechanism 50 will be described.

Figure 5:
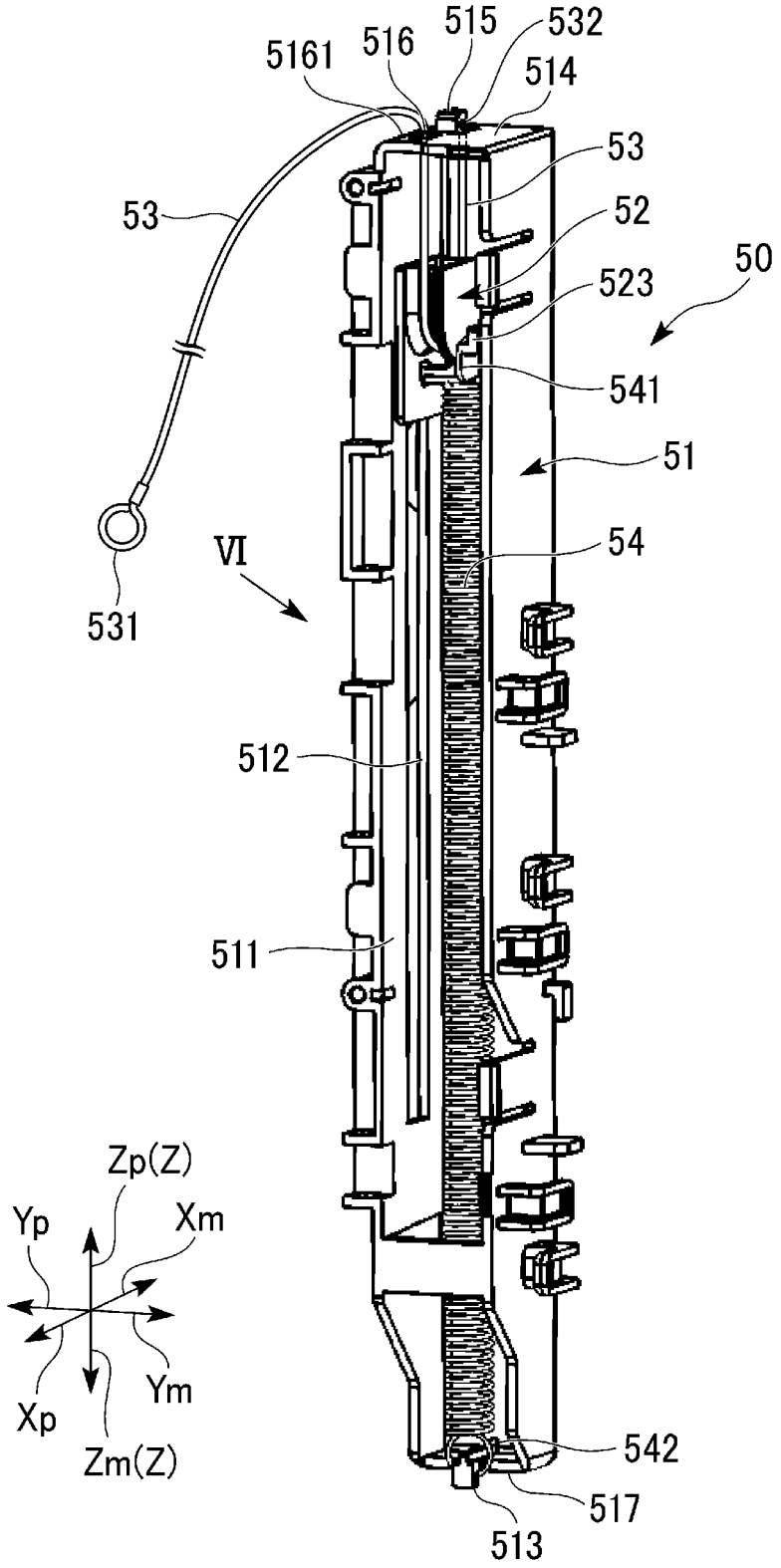
FIG. 5 is a schematic perspective view illustrating a configuration example of a sagging prevention mechanism in the image processing apparatus.
Figure 6:
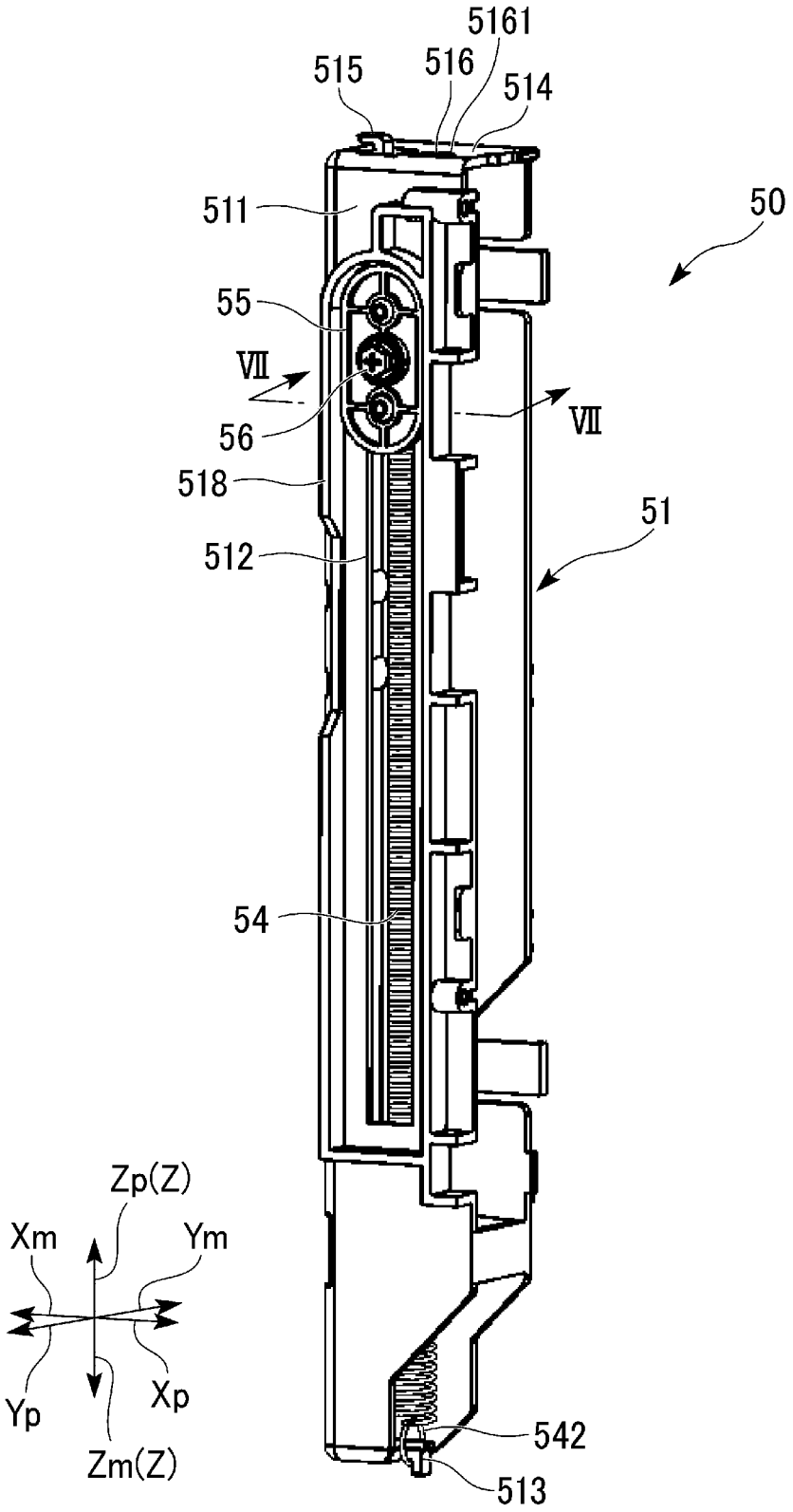
FIG. 6 is a schematic perspective view taken along VI in FIG. 5.
Figure 7:
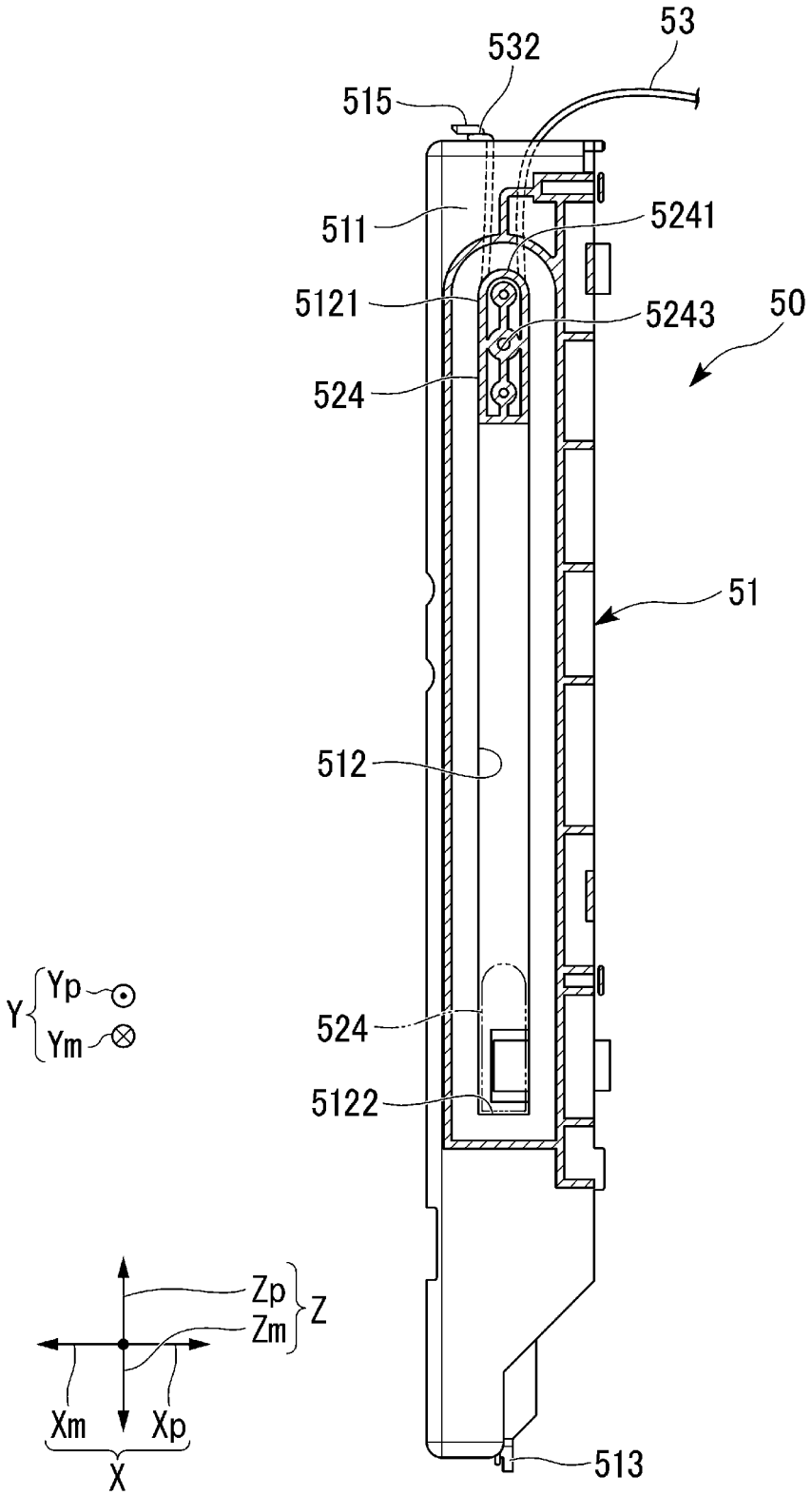
FIG. 7 is a schematic cross-sectional view taken along line VII-VII in FIG. 6.

FIG. 5 is a schematic perspective view illustrating a configuration example of the sagging prevention mechanism in the image processing apparatus according to the embodiment. FIG. 6 is a schematic perspective view taken along VI in FIG. 5. FIG. 7 is a schematic cross-sectional view taken along line VII-VII in FIG. 6.

The sagging prevention mechanism 50 pulls the connection member 53 and suppresses sagging of the connection member 53 outside of the apparatus main body 60.

As illustrated in FIG. 5, the sagging prevention mechanism 50 includes a case 51 (accommodation portion), a direction change member 52, and an elastic member 54.

The case 51 is an example of the accommodation portion that accommodates a portion of the connection member 53 and the direction change member 52, the portion of the connection member 53 being folded by the direction change member 52 described below.

The case 51 is a box shape that is elongated in the Z direction and has an opening in the Xp direction. The case 51 may be formed of a metal or a synthetic resin. In an example illustrated in FIG. 5, the case 51 is formed of a resin molded article.

As illustrated in FIG. 4, the case 51 is disposed at a position facing the exterior cover 41 of the conveyance unit 40 in the closed state in the Xm direction with respect to the rear plate 61.

An upper plate 514 parallel to the XY plane is provided at an end portion of the case 51 in the Zp direction.

In the upper plate 514, a through hole 516 that penetrates the upper plate 514 in a thickness direction is formed.

A hook 515 (engagement portion) that extends in the Zp direction and is bent in the Xm direction is provided at an inner edge of the through hole 516 in the Xm direction.

A second end portion 532 of the connection member 53 opposite to the first end portion 531 engages with the hook 515. The hook 515 is an example of the engagement portion that engages with an end portion of the connection member 53.

The second end portion 532 may be or may not be attachable and detachable and may engage with the hook 515. In other words, the second end portion 532 may be fixed to the upper plate 514. In the example illustrated in FIG. 5, the second end portion 532 has a ring shape having a size in which the hook 515 can be inserted, and is attachable and detachable and engages with the hook 515.

A sliding portion 5161 with which the connection member 53 is movable in the longitudinal direction and comes into contact is formed at an inner edge of the through hole 516 in the Xp direction. The sliding portion 5161 is formed of a material having a lower sliding friction than the connection member 53.

A hook 513 that engages with the elastic member 54 described below is provided at an end portion of the case 51 in the Zm direction.

The hook 513 has, for example, an L-shape when seen from the Yp direction. The hook 513 extends in the Xp direction from an end portion of a lower plate 517 in the Xp direction facing the upper plate 514 in the Z direction and is bent in the Zm direction.

A side plate 511 parallel to the ZX plane is provided between respective end portions of the upper plate 514 and the lower plate 517 in the Yp direction.

As illustrated in FIG. 6, a guide hole 512 that extends in the Z direction is formed in a thickness direction of the side plate 511. In the side plate 511 in the vicinity of the guide hole 512, a rib 518 protrudes in the Yp direction. When seen from the Ym direction, the rib 518 has a shape substantially similar to that of the guide hole 512.

An upper engagement portion 5121 having a semi-circular shape when seen from the Ym direction is formed at an end portion of the guide hole 512 in the Zp direction. A lower engagement portion 5122 that extends in the X direction when seen from the Ym direction is formed at an end portion of the guide hole 512 in the Zm direction.

As illustrated in FIG. 5, the direction change member 52 is provided in the case 51 to be movable in a longitudinal direction of the guide hole 512.

The direction change member 52 folds the connection member 53 in a U-shape between the hook 515 and the sliding portion 5161. Further, the direction change member 52 engages with the connection member 53 between the hook 515 and the sliding portion 5161 such that the connection member 53 is relatively movable in the longitudinal direction of the connection member 53.

Figure 8C:
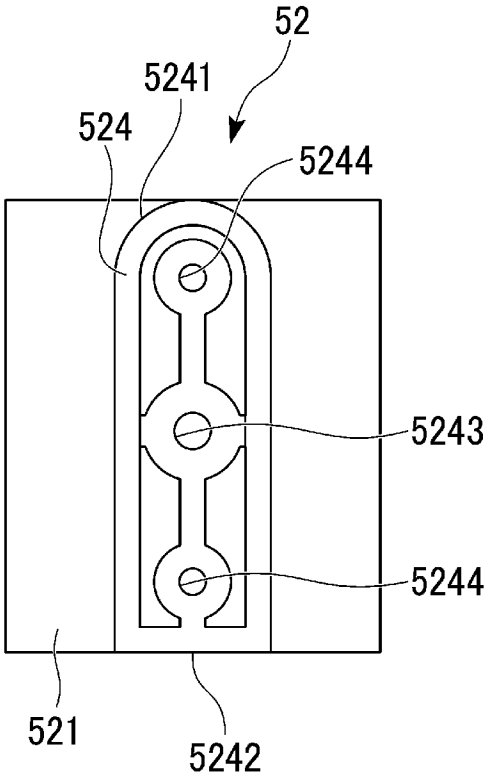
FIGS. 8A to 8C are a schematic front view, a schematic right side view, and a schematic rear view illustrating an example of a direction change member in the image processing apparatus.
Figure 8B:
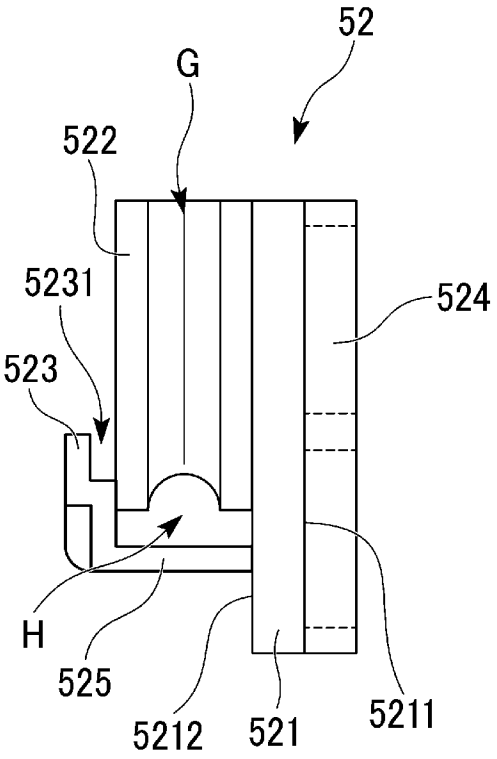
Figure 8A:
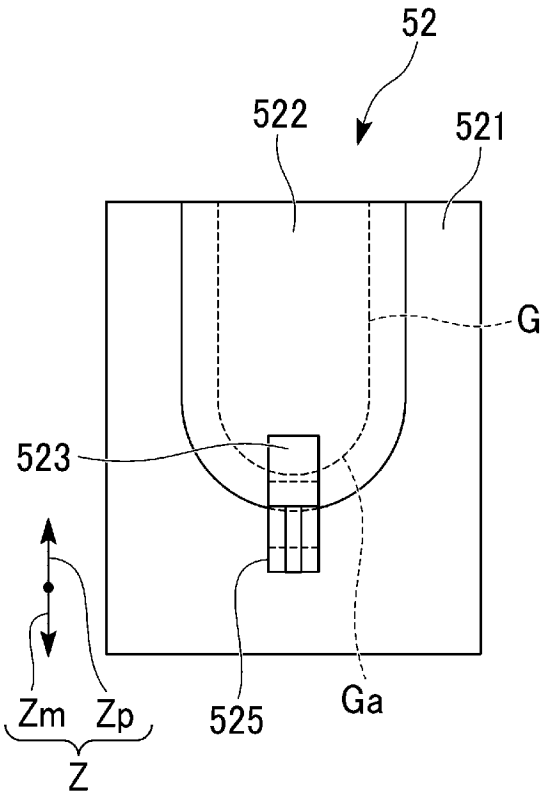

FIGS. 8A to 8C are a front view, a right side view, and a rear view illustrating an example of the direction change member in the image processing apparatus according to the embodiment. FIG. 8A is a front view of the direction change member 52 (when seen from the Yp direction), FIG. 8B is a right side view of the direction change member 52 (when seen from the Xp direction), and FIG. 8C is a rear view of the direction change member 52 (when seen from the Ym direction).

As illustrated in FIG. 8B, the direction change member 52 includes a base 521, a winding portion 522, a hook 523, and a slider 524.

The base 521 is a flat plate in which a first surface 5211 in a plate thickness direction is provided along an inner surface of the side plate 511 of the case 51.

The winding portion 522 is a stepwise member that protrudes to a second surface 5212 opposite to the first surface 5211 in the case 51. As illustrated in FIG. 8A, the external shape of the winding portion 522 in a front view is a convex U-shape in the Zm direction. In a U-shaped outer circumferential portion of the winding portion 522, a groove G that winds the connection member 53 in a U-shape is formed.

A cross-section of the groove in a direction perpendicular to an extending direction of the groove G (direction along the outer circumferential portion of the winding portion 522) has a shape in which the connection member 53 is slidable. For example, in the example illustrated in FIG. 8B, the groove G has a U-shape corresponding to a substantially circular shape that is a cross-sectional shape of the connection member 53. However, the shape of the groove G may be, for example, a rectangular shape or a V-shape even when the cross-sectional shape of the connection member 53 is substantially circular.

As illustrated in FIGS. 8A and 8B, the hook 523 extends in the Zp direction from an end portion of the winding portion 522 in the Zm direction. An engagement groove 5231 that engages the elastic member 54 described below from above in the drawing is formed between the hook 523 and the winding portion 522.

A plate-shaped or rod-shaped guard 525 extends between a lower end portion of the hook 523 in the drawing and the second surface 5212. An opening portion H into which the connection member 53 can be inserted is formed between the guard 525 and the groove G (refer to FIG. 8B). The guard 525 prevents the connection member 53 from deviating from the groove G in the Zm direction.

As illustrated in FIG. 8B, the slider 524 protrudes from the first surface 5211 of the base 521. The slider 524 is a protrusion that is slidable and fitted to the guide hole 512 of the case 51 in the longitudinal direction. The height of the slider 524 is slightly higher than the thickness of the side plate 511.

As illustrated in FIG. 8C, the external shape of the slider 524 is an inverted U-shape extending in the Z direction.

An upper end portion 5241 of the slider 524 in the Zp direction has a semi-circular shape that can engage with the upper engagement portion 5121 of the guide hole 512.

A lower end portion 5242 of the slider 524 in the Zm direction has a planar shape that can engage with the lower engagement portion 5122 of the guide hole 512.

In the slider 524, a fixing hole 5243 that fixes a stopper plate 55 described below and two positioning holes 5244 that position the stopper plate 55 are provided.

As illustrated in FIG. 6, the stopper plate 55 can be inserted into the rib 518. The stopper plate 55 has a plate member that has a wider width than that of the guide hole 512 in the X direction and has an elongated circular shape in the Z direction.

The stopper plate 55 is fixed to the fixing hole 5243 of the slider 524 through a screw 56.

Therefore, the side plate 511 at an inner edge of the guide hole 512 is interposed in the Y direction between the base 521 and the stopper plate 55 of the direction change member 52.

With this configuration, the slider 524 is movable in the Z direction conforming to the longitudinal direction of the guide hole 512 between a first position indicated by a solid line in FIG. 7 and a second position indicated by a two-dot chain line in FIG. 7.

The first position is a position where the upper end portion 5241 of the slider 524 and the upper engagement portion 5121 of the guide hole 512 abut against each other.

The second position is a position where the lower end portion 5242 of the slider 524 and the lower engagement portion 5122 of the guide hole 512 abut against each other.

As illustrated in FIG. 5, the elastic member 54 pulls the direction change member 52 in the Zm direction. The elastic member 54 forms a tensile force in the Z direction between the hook 523 of the direction change member 52 and the hook 513 of the case 51. The configuration of the elastic member 54 is not particularly limited as long as it is an elastic body having elasticity in the Z direction and can form a tensile force in the Z direction.

In the example illustrated in FIG. 5, the elastic member 54 is a tensile coil spring extending in the Z direction. An upper hook 541 is provided at an end portion of the elastic member 54 in the Zp direction, and a lower hook 542 is provided at an end portion of the elastic member 54 in the Zm direction.

The upper hook 541 engages with the hook 523 of the direction change member 52 from above.

The lower hook 542 engages with the hook 513 of the case 51 from below.

Even when the direction change member 52 is moved to the second position, the elastic member 54 pulls the direction change member 52 in the Zm direction.

As illustrated in FIG. 1, the control circuit 6 controls the image processing apparatus 100 as a whole and the respective device portions. For example, the control circuit 6 controls the control panel 1, the scanner unit 2, the printer unit 3, the sheet supply unit 4, the conveying unit 5, and the manual feed unit 10 such that the sheet S is conveyed and an image is formed on the sheet S.

As a device configuration of the control circuit 6, for example, a processor such as a central processing unit (CPU) may be used.

Next, an operation of the sagging prevention mechanism 50 in the image processing apparatus 100 will be described.

Figure 9A:
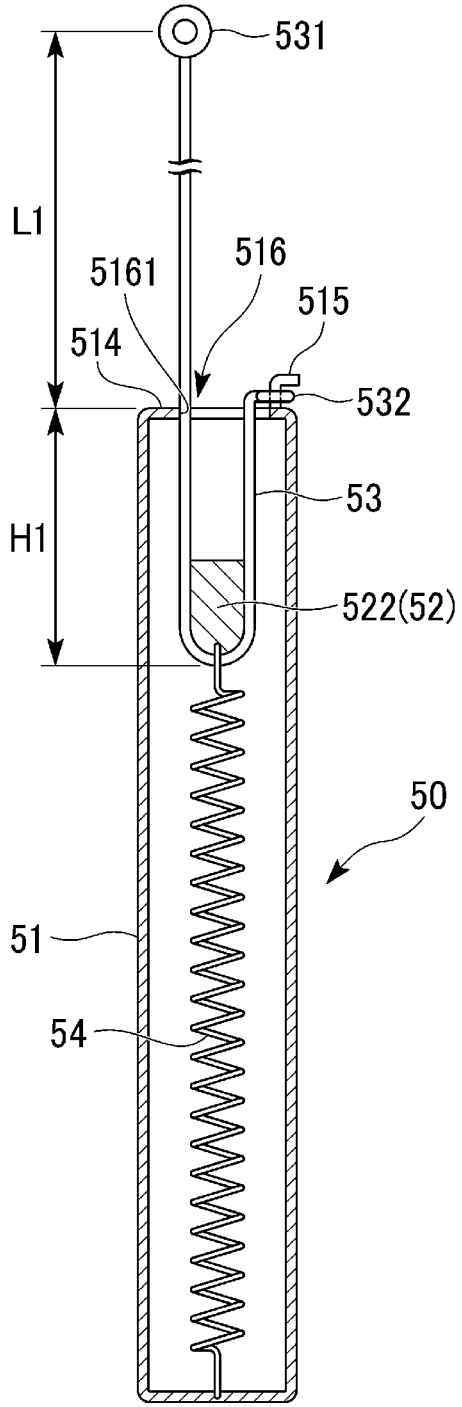
FIGS. 9A and 9B are diagrams illustrating an operation of the sagging prevention mechanism.
Figure 9B:
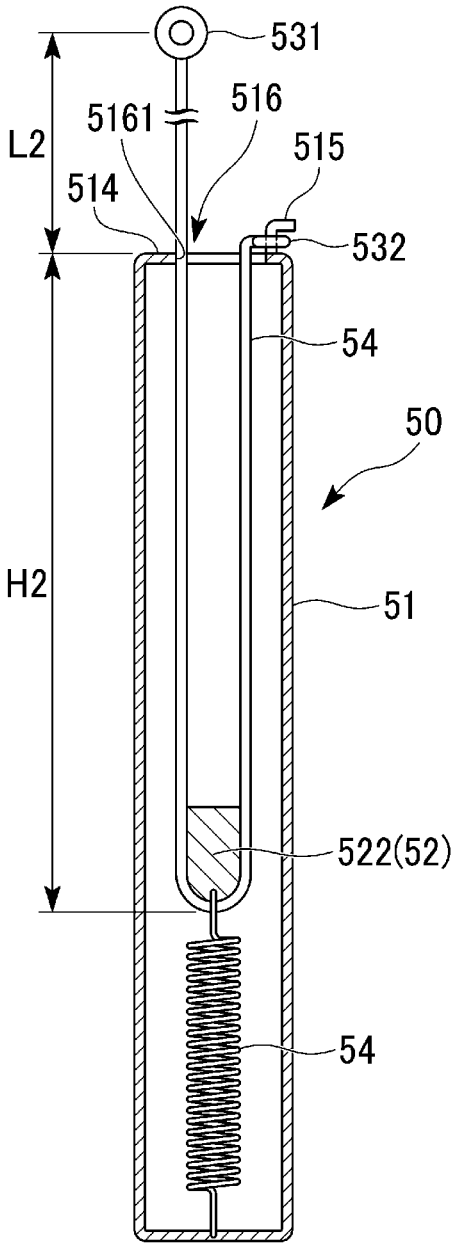

FIGS. 9A and 9B are diagrams illustrating the operation of the sagging prevention mechanism in the image processing apparatus according to the embodiment.

FIG. 9A schematically illustrates a state where the direction change member 52 is moved to the first position, and FIG. 9B schematically illustrates a state where the direction change member 52 is moved to the second position. For example, in the image processing apparatus 100, the connection member 53 is bent toward the fixing portion 121 by the sliding portion 5161. However, FIGS. 9A and 9B illustrate a state where the connection member 53 is not bent.

As illustrated in FIG. 9A, the direction change member 52 is moved to the first position if the connection member 53 is drawn out to the outside of the case 51 by a length L1.

As illustrated in FIG. 9B, if the direction change member 52 is positioned at the second position, the length of the connection member 53 by which the connection member 53 is drawn out to the outside of the case 51 is L2 (where L2<L1).

If the manual feed tray 12 and the conveyance unit 40 are closed, the direction change member 52 is positioned at the second position.

If the manual feed tray 12 is opened or not only the conveyance unit 40 but also the manual feed tray 12 are rotated, the manual feed tray 12 is tilted with respect to a vertical surface. At this time, the first end portion 531 of the connection member 53 connected to the fixing portion 121 of the manual feed tray 12 is pulled to the outside of the case 51 by the manual feed tray 12. The direction change member 52 moves to the second position in the Zp direction. The connection member 53 is drawn out to the outside of the case 51 through the sliding portion 5161.

The elastic restoring force of the connection member 53 is set to a size not exceeding an external force if the manual feed tray 12 is opened. Therefore, the elastic member 54 is expanded without interfering the rotation of the manual feed tray 12. A tensile force is applied to the connection member 53 extending to the outside of the case 51 by the elastic member 54. Therefore, sagging is suppressed. As illustrated in FIGS. 3 and 4, the connection member 53 is stretched between the fixing portion 121 and the sliding portion 5161.

As illustrated in FIG. 9A, if the direction change member 52 is moved to the first position and engages with the case 51, the direction change member 52 cannot be moved in the Zp direction. The amount by which the connection member 53 is drawn out is a maximum value L1.

As a result, atilt angle of the manual feed tray 12 cannot exceed an angle at which the distance between the fixing portion 121 and the sliding portion 5161 is L1.

The maximum tilt angle of the manual feed tray 12 is larger by Δ than a tilt angle θ at which the manual feed tray 12 is opened in the closed state of the conveyance unit 40. The maximum tilt angle (θ+Δ) of the manual feed tray 12 is more preferably about 90 degrees and may be larger than 90 degrees as long as the sheet S placed on the manual feed tray 12 does not slide off.

If the amount in which the connection member 53 is drawn out is L1, the winding portion 522 draws the connection member 53 from the upper plate 514 by a distance H1. Therefore, the length that is about two times H1 in the connection member 53 is drawn into the case 51.

If the tilt angle of the manual feed tray 12 from a vertical line decreases by rotating the manual feed tray 12 toward the apparatus main body 60, the elastic member 54 contracts, and the direction change member 52 is pulled in the Zm direction. Since the connection member 53 is drawn into the case 51, sagging of the connection member 53 between the fixing portion 121 and the sliding portion 5161 is suppressed.

Therefore, if the manual feed tray 12 is closed, the connection member 53 is not interposed between the manual feed tray 12 and the conveyance unit 40, and thus the operability of the manual feed tray 12 is improved.

As illustrated in FIG. 9B, the direction change member 52 moves up to the second position in the Zm direction. At this time, as illustrated in FIG. 7, the lower end portion 5242 is pressed against the lower engagement portion 5122 by the elastic restoring force of the elastic member 54.

As illustrated in FIG. 9B, the amount in which the connection member 53 is drawn out is a minimum value L2 if the direction change member 52 is moved to the second position. The winding portion 522 draws the connection member 53 from the upper plate 514 by a distance H2.

The winding portion 522 folds the connection member 53 in a U-shape and pulls the connection member 53 in the Zm direction. Therefore, L2 is drawn by a length that is two times the amount in which the winding portion 522 is moved down. Therefore, L2=L1−2×(H2−H1).

With the sagging prevention mechanism 50, the connection member 53 can be compactly accommodated in the case 51.

L2 is a length at which the connection member 53 between the fixing portion 121 and the sliding portion 5161 is slightly sagged in a state where the manual feed tray 12 is closed in the closed state of the conveyance unit 40.

As a result, the elastic member 54 is expanded slightly after the manual feed tray 12 starts to be opened. Therefore, a load on the user if the manual feed tray 12 starts to be opened can be reduced.

Next, an operation of the image processing apparatus 100 will be described.

In the image processing apparatus 100 illustrated in FIG. 1, conditions such as the kind of the sheet S on which an image is to be formed or the amount of sheets to be printed are set by operating the control panel 1 or based on an external signal, and subsequently an image starts to be formed by a print start signal to be generated. Image information is read from a copying object by the scanner unit 2 and is transmitted to the printer unit 3. Alternatively, image information is transmitted to the printer unit 3 from an external apparatus. The printer unit 3 supplies the sheet S in the sheet supply unit 4 or the sheet S in the manual feed unit 10 to the registration roller 24 based on a control signal to be generated by the control circuit 6 in response to the condition setting and the reception of the print start signal. Hereinafter, for example, a case where the sheet S is supplied from the manual feed unit 10 will be described as an example.

A user opens the manual feed tray 12 and sets the sheet S on the manual feed tray 12.

If an operation for forming an image is input from the control panel 1, the control circuit 6 executes a control to start paper feed from the manual feed unit 10 and image formation.

Each of the image forming units 25 forms an electrostatic latent image on each of the photoconductive drums 7 based on image information corresponding to a color. Each of the electrostatic latent images is developed by the developing unit 8. Therefore, a toner image corresponding to the electrostatic latent image is formed on the surface of each of the photoconductive drums 7.

Each of the toner images is transferred to the intermediate transfer belt 27 by each of the transfer rollers. The respective toner images are sequentially superimposed on the intermediate transfer belt 27 according to the movement of the intermediate transfer belt 27 without a color shift, and the superimposed toner image is transmitted to the transfer unit 28.

The sheet S is supplied from the registration roller 24 to the transfer unit 28. The toner image that reaches the transfer unit 28 is secondarily transferred to the sheet S. The secondarily transferred toner image is fixed to the sheet S by the fixing unit 29. The sheet S is discharged to a paper discharge port through the conveyance path 303.

As a result, an image is formed on the sheet S.

In this image forming operation, the sheet S may be jammed (paper clogging) in the conveyance path. If the sheet S is jammed, it is necessary for the user to remove the jammed sheet S (jammed paper).

For example, if the sheet S is jammed in the conveyance path 301, 302, or 304, the conveyance unit 40 is opened. At this time, in a recommended procedure to cope with a paper jam, first, the user retreats the sheet S from the manual feed tray 12 and closes the manual feed tray 12. Next, the user opens the conveyance unit 40.

The conveyance unit 40 is supported by the connection band 43 from the apparatus main body 60.

In a state where the manual feed tray 12 is closed and accommodated in the conveyance unit 40, the manual feed tray 12 is locked in the conveyance unit 40 in the accommodated state. Therefore, even when the conveyance unit 40 is opened, the manual feed tray 12 does not open due to its weight.

By opening the conveyance unit 40 as illustrated in FIG. 4, the conveyance paths 301 and 302 and a part of the conveyance path 304 are opened, and thus the user can remove jammed paper.

The user may open the conveyance unit 40 in a state where the user forgets to close the manual feed tray 12. In this case, the conveyance unit 40 is rotated in a state where the manual feed tray 12 is opened from the conveyance unit 40. The sheet S may also be placed on the manual feed tray 12.

As illustrated in FIG. 3, immediately before the conveyance unit 40 is opened, the opened manual feed tray 12 is supported by the conveyance unit 40 through each of the links 13. The amount in which the connection member 53 is drawn out is less than L1. If the conveyance unit 40 starts to be opened and the manual feed tray 12 is tilted together with the conveyance unit 40, the connection member 53 extends to the outside of the case 51 until the amount in which the connection member 53 is drawn out reaches L1.

Figure 10:
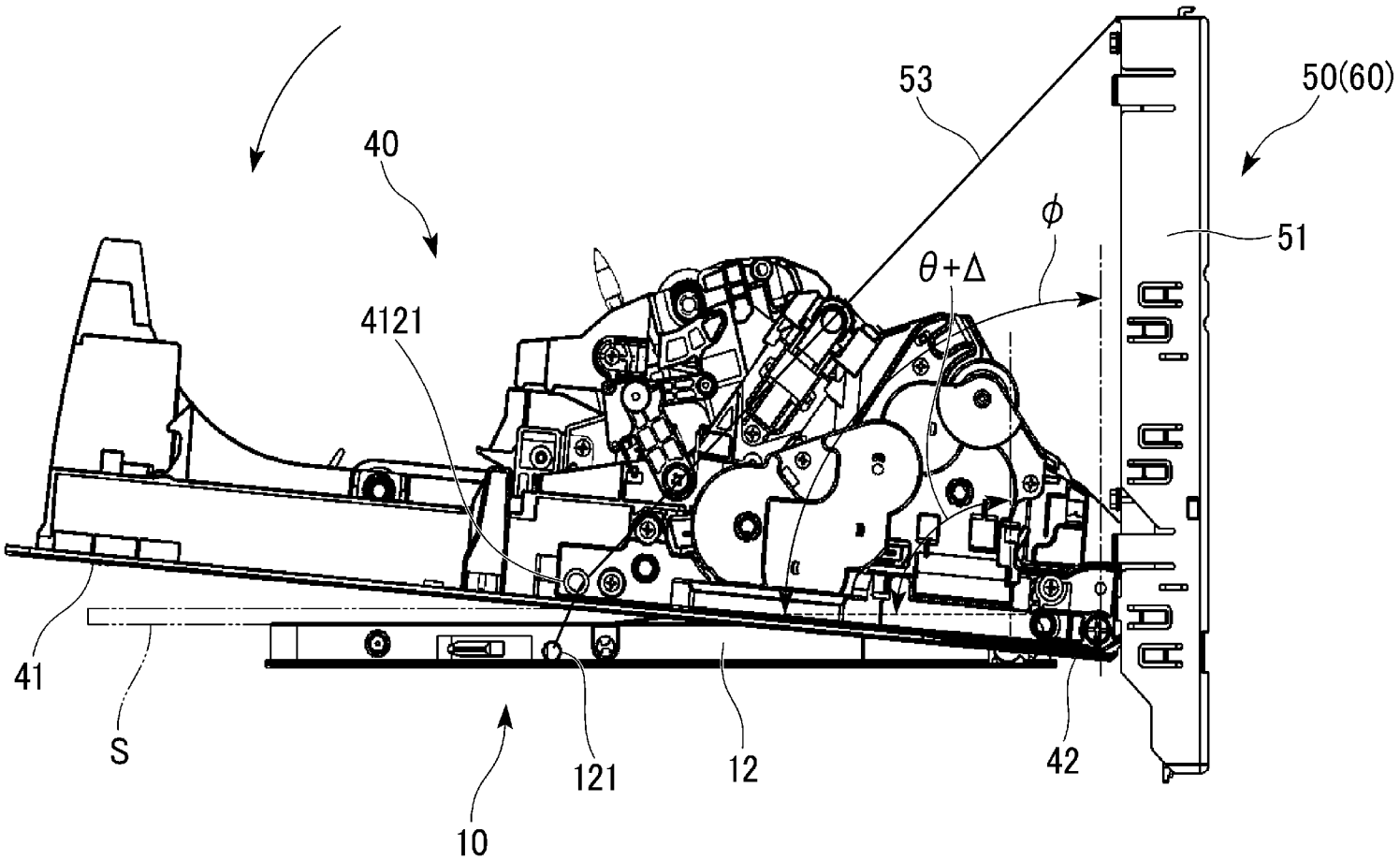
FIG. 10 is a schematic rear view illustrating a state where a conveyance unit in the image processing apparatus is opened.

FIG. 10 is a schematic rear view illustrating a state where a conveyance unit in the image processing apparatus according to the embodiment is opened. In FIG. 10, in order to avoid overlapping with the connection member 53, the connection band 43 is not illustrated.

As illustrated in FIG. 10, in the embodiment, if the conveyance unit 40 is opened, the conveyance unit 40 rotates up to a given angle θ at which the connection band 43 (not illustrated) is stretched. The size of the angle θ is not particularly limited as long as jammed paper can be removed.

The connection member 53 is simply inserted into the hole 4121 of the conveyance unit 40. Therefore, the rotation of the conveyance unit 40 is not restricted by the connection member 53.

The manual feed tray 12 is connected to the apparatus main body 60 through the connection member 53. Therefore, the manual feed tray 12 cannot be tilted at an angle exceeding the tilt angle (θ+Δ) at which the connection member 53 is drawn out by L1.

In the embodiment, the tilt angle (θ+Δ) is slightly larger than the tilt angle θ in the opened state of the conveyance unit 40. In the example illustrated in FIG. 10, a difference between the tilt angle (θ+Δ) and the angle θ is such that all the sheets S that can be stacked are interposed between and the manual feed tray 12 and the conveyance unit 40 tilted by the angle θ.

This way, in the embodiment, the conveyance unit 40 in the opened state is suspended from the apparatus main body 60 by the connection band 43, and a load on the conveyance unit 40 is not transmitted to the manual feed tray 12.

The manual feed tray 12 and the sheet S on the manual feed tray 12 are suspended from the apparatus main body 60 by the connection member 53. Therefore, even when the conveyance unit 40 is vigorously opened, the manual feed tray 12 and the connection member 53 are not affected by an impact during the opening of the conveyance unit 40.

By setting the tilt angle (θ+Δ) to an angle at which the sheet S does not slide off, even when the conveyance unit 40 is opened in a state where the user opens the manual feed tray 12, the sheet S on the manual feed tray 12 does not slide off.

The action of the image processing apparatus 100 will be described as compared to Comparative Example.

Figure 11B:
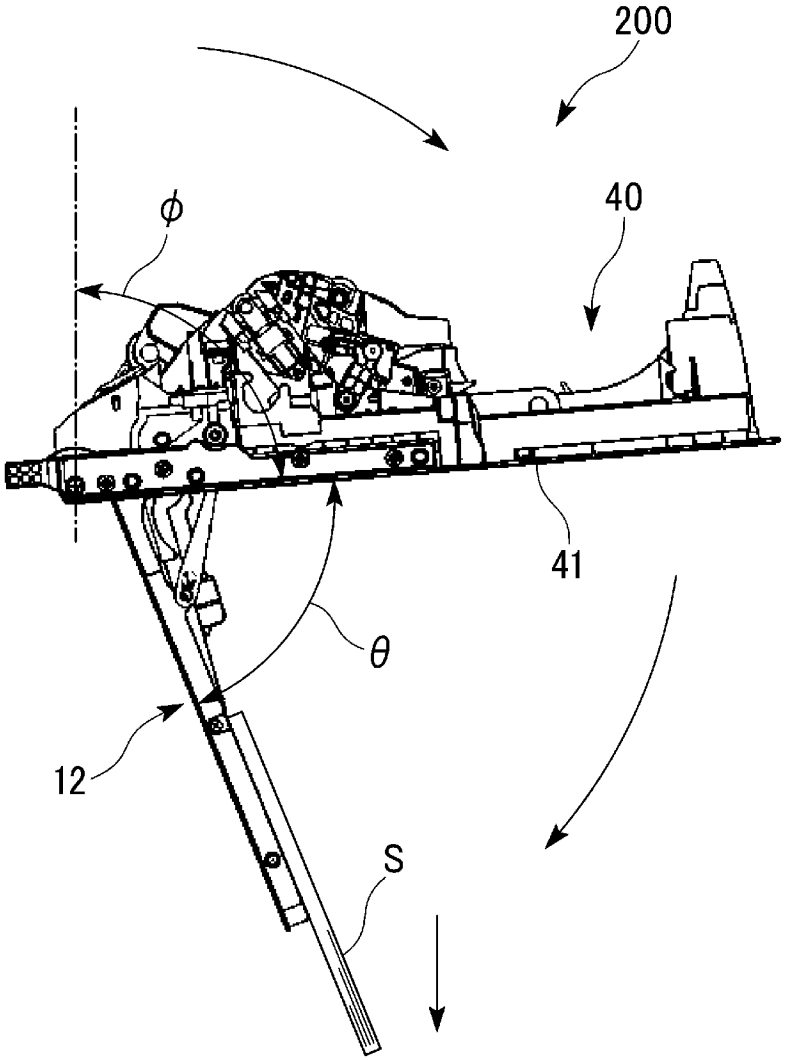
FIGS. 11A and 11B are diagrams illustrating an operation of an image processing apparatus according to Comparative Example.
Figure 11A:
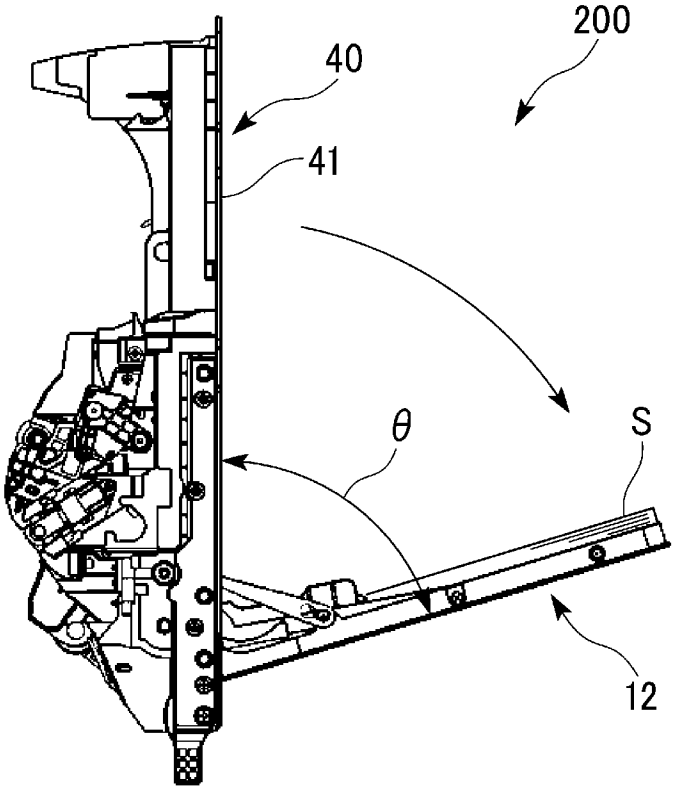

FIGS. 11A and 11B are diagrams illustrating an operation of an image processing apparatus according to Comparative Example. FIG. 11A illustrates a state where the manual feed tray is opened in the closed state of the conveyance unit. FIG. 11B illustrates a state where the manual feed tray is opened in the opened state of the conveyance unit.

As illustrated in FIG. 11A, an image processing apparatus 200 according to Comparative Example has the same configuration as that of the image processing apparatus 100 except that it does not include the connection member 53 and the sagging prevention mechanism 50.

The tilt angle in the opened state of the manual feed tray 12 is θ that is the same as that of the embodiment with respect to a vertical line.

If the conveyance unit 40 is opened in this state, as illustrated in FIG. 11B, the conveyance unit 40 also rotates in a state where the manual feed tray 12 is tilted by the angle θ with respect to the exterior cover 41. The manual feed tray 12 is titled by ϕ+θ with respect to a vertical line.

ϕ and θ are preferably angles similar to 90 degrees. Therefore, if the sheet S is placed on the manual feed tray 12, the sheet S falls down.

If the sheet S falls off, in order to continue image formation after removing jammed paper, it is necessary to reset the sheet S on the manual feed tray 12. If the sheet S is contaminated or folded during the fall of the sheet S, there may be a case where the sheet S cannot be reused.

For example, if any obstacle is disposed below the manual feed tray 12 in the opened state, the obstacle may collide with the manual feed tray 12 so that the obstacle or the manual feed tray 12 may be damaged.

This way, in the image processing apparatus 200 according to Comparative Example, if the conveyance unit 40 is opened in the opened state of the manual feed tray 12, the tilt of the manual feed tray 12 cannot be restricted.

On the other hand, in the embodiment, the tilt of the manual feed tray 12 can be restricted by the connection member 53. Therefore, the sheet S on the manual feed tray 12 can be prevented from falling off. Further, even when an obstacle is disposed below the manual feed tray 12, the manual feed tray 12 can be prevented from colliding with the obstacle.

As described above, in the image processing apparatus 100 according to the embodiment, the manual feed tray 12 is connected to the sagging prevention mechanism 50 of the apparatus main body 60 through the connection member 53. The tilt of the manual feed tray 12 is restricted according to the amount in which the connection member 53 is drawn out from the sagging prevention mechanism 50. Therefore, the embodiment can provide an image processing apparatus in which the tilt of the manual feed tray 12 can be restricted even when the conveyance unit 40 is opened in the opened state of the manual feed tray 12.

In particular, the connection member 53 is pulled by the elastic member 54 of the case 51. Therefore, the sagging of the connection member 53 during opening and closing of the manual feed tray 12 is restricted. For example, if the manual feed tray 12 is closed, the sagging of the connection member 53 does not occur. Therefore, the connection member 53 is smoothly closed without being interposed between the conveyance unit 40 and the manual feed tray 12.

The case 51 folds the connection member 53 in a U-shape and accommodates the connection member 53. Therefore, the connection member 53 can be compactly accommodated. Thus, the size of the image processing apparatus 100 can be reduced.

Hereinafter, modification examples of the above-described embodiment will be described.

In the description of the embodiment, the example where the maximum tilt angle ($\theta+\Delta$) of the manual feed tray 12 is larger than the tilt angle $\phi$ of the conveyance unit 40 is described. However, $\theta+\Delta$ may be the same as $\phi$. In this case, the conveyance unit 40 and the manual feed tray 12 are supported by the connection band 43 and the connection member 53, respectively at the same tilt angle.

In this case, the connection band 43 is not necessarily provided as long as the connection strength between the connection member 53 and the manual feed tray 12 and the sagging prevention mechanism 50 and the strength of the connection member 53 itself are set such that the conveyance unit 40 on the manual feed tray 12 can be supported.

In the description of the embodiment, if the manual feed tray 12 is closed, the manual feed tray 12 is accommodated in the recessed manual feed tray accommodation portion 411 of the exterior cover 41. However, if the manual feed tray 12 is closed, the manual feed tray 12 may be adjacent to the exterior cover 41 in a state where it protrudes from the exterior cover 41 to the outside. In this case, the manual feed tray accommodation portion 411 is not necessarily provided in the exterior cover 41.

In the embodiment, the image processing apparatus 100 executes image formation. However, the image processing apparatus 100 may execute image processing instead of image formation. For example, the image processing apparatus 100 may erase an image formed with decolorable toner with heating, light irradiation, or the like.

As described above, in at least one of the embodiments, it is possible to provide an image processing apparatus in which tilt of a second rotating body can be restricted even when a first rotating body is opened in a state where the second rotating body is opened. The image processing apparatus includes: an apparatus main body; a first rotating body configured to be openable and closeable and provided in the apparatus main body; a second rotating body configured to be openable and closable from the first rotating body in the same direction as that of the first rotating body, the second rotating body being provided in the first rotating body; and a linear connection member configured to connect the apparatus main body and the second rotating body to each other and to restrict a rotation angle of the second rotating body.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such embodiments or modifications as would fall within the scope and spirit of the invention.

What is claimed is:

1. An image processing apparatus, comprising:

an apparatus main body;

a first rotating body configured to be openable and closeable and provided in the apparatus main body;

a second rotating body configured to be openable and closable from the first rotating body in a same direction as the first rotating body, the second rotating body being provided in the first rotating body; and a linear connection member configured to connect the apparatus main body and the second rotating body to each other and to restrict a rotation angle of the second rotating body, wherein the apparatus main body comprises a sagging restriction mechanism configured to pull the linear connection member to suppress sagging of the linear connection member outside of the apparatus main body wherein the sagging restriction mechanism comprises:

an engagement portion configured to engage with an end portion of the linear connection member, a sliding portion with which the linear connection member is movable and comes into contact in a longitudinal direction of the linear connection member, a direction change member configured to fold the linear connection member in a U-shape between the engagement portion and the sliding portion and to engage with the linear connection member between the engagement portion and the sliding portion such that the linear connection member is at least partially movable in the longitudinal direction, an elastic member configured to pull the direction change member, and an accommodation portion configured to accommodate a portion of the linear connection member and the direction change member, the portion of the linear connection member being folded by the direction change member.

2. The image processing apparatus according to claim 1, wherein the linear connection member is positioned at least partially within an insertion hole formed in the first rotating body, and the first rotating body is rotatable from the apparatus main body to an opening position of the second rotating body.

3. The image processing apparatus according to claim 1, wherein the first rotating body is a conveyance component including a part of a conveyance path of a sheet, and the second rotating body is a manual feed tray.

4. The image processing apparatus according to claim 1, wherein the first rotating body is configured to be rotatable about 90°.

5. The image processing apparatus according to claim 1, wherein the second rotating body configured to be rotatable about 90°.

6. The image processing apparatus according to claim 1, wherein the linear connection member is a wire or a rope.

7. The image processing apparatus according to claim 1, wherein the linear connection member comprises a metal or a resin.

8. A method to facilitate removal of a jammed sheet within an image processing apparatus, comprising:

opening a first rotating body in the image processing apparatus;

opening a second rotating body in the first rotating body in a same direction as the first rotating body; and restricting a rotation angle of the second rotating body using a linear connection member connecting the image processing apparatus and the second rotating body to each other;

pulling the linear connection member to suppress sagging of the linear connection member outside of the apparatus main body by:

pulling a direction change member by an elastic member, wherein the direction change member is configured to fold the linear connection member in a U-shape between an engagement portion configured to engage with an end portion of the linear connection member and a sliding portion with which the linear connection member is movable and comes into contact in a longitudinal direction of the linear connection member, wherein the direction change member engages with the linear connection member between the engagement portion and the sliding portion such that the linear connection member is at least partially movable in the longitudinal direction, and wherein an accommodation portion configured to accommodate a portion of the linear connection member and the direction change member, the portion of the linear connection member being folded by the direction change member;

removing the jammed sheet;

closing the second rotating body in the first rotating body; and closing the first rotating body in the image processing apparatus.

9. The method according to claim 8, further comprising:

rotating the first rotating body about 90°; and rotating the second rotating body about 90°.

10. A sheet handling apparatus, comprising:

a first rotating body configured to be openable and closeable to an image processing apparatus;

a second rotating body configured to be openable and closable from the first rotating body in a same direction as the first rotating body, the second rotating body being provided in the first rotating body; and a linear connection member configured to connect the image processing apparatus and the second rotating body to each other and to restrict a rotation angle of the second rotating body, wherein the image processing apparatus comprises a sagging restriction mechanism configured to pull the linear connection member to suppress sagging of the linear connection member outside of the image processing apparatus wherein the sagging restriction mechanism comprises:

an engagement portion configured to engage with an end portion of the linear connection member, a sliding portion with which the linear connection member is movable and comes into contact in a longitudinal direction of the linear connection member, a direction change member configured to fold the linear connection member in a U-shape between the engagement portion and the sliding portion and to engage with the linear connection member between the engagement portion and the sliding portion such that the linear connection member is at least partially movable in the longitudinal direction, an elastic member configured to pull the direction change member, and an accommodation portion configured to accommodate a portion of the linear connection member and the direction change member, the portion of the linear connection member being folded by the direction change member.

11. The sheet handling apparatus according to claim 10, wherein the linear connection member is positioned at least partially within an insertion hole formed in the first rotating body, and the first rotating body is rotatable from the image processing apparatus to an opening position of the second rotating body.

12. The sheet handling apparatus according to claim 10, wherein the first rotating body is a conveyance component including a part of a conveyance path of a sheet, and the second rotating body is a manual feed tray.

13. The sheet handling apparatus according to claim 10, wherein the first rotating body is configured to be rotatable about 90°.

14. The sheet handling apparatus according to claim 10, wherein the second rotating body configured to be rotatable about 90°.

15. The sheet handling apparatus according to claim 10, wherein the linear connection member is a wire or a rope.

16. The sheet handling apparatus according to claim 10, wherein the linear connection member comprises a metal or a resin.

* * * * *